US006273308B1

(12) United States Patent
Choshi

(10) Patent No.: US 6,273,308 B1
(45) Date of Patent: Aug. 14, 2001

(54) AUTOMATIC MOLTEN METAL INJECTOR

(75) Inventor: Yukihisa Choshi, Osaka (JP)

(73) Assignee: Shin-Ei Die Casting Ind. Co., Ltd., Osaka (JP)

( * ) Notice: Subject to any disclaimer, the term of this patent is extended or adjusted under 35 U.S.C. 154(b) by 0 days.

(21) Appl. No.: 09/526,727

(22) Filed: Mar. 16, 2000

(30) Foreign Application Priority Data

Mar. 19, 1999 (JP) ..... 11-075860

(51) Int. Cl.[7] ..... B67D 1/10
(52) U.S. Cl. ..... 222/596; 266/239
(58) Field of Search ..... 222/590, 591, 222/596; 266/239; 164/143, 312

(56) References Cited

U.S. PATENT DOCUMENTS 2,835,005 * 5/1958 Green ..... 222/596
3,396,873 8/1968 Nef .
3,652,073 3/1972 Lewis .

FOREIGN PATENT DOCUMENTS 446 116 6/1942 (BE) .
502 284 9/1992 (EP) .
40847765-A * 8/1996 (JP) .

OTHER PUBLICATIONS

Patent Abstracts of Japan, vol. 1996, No. 06, Jun. 28, 1996 & JP 08 047765 A, Nagako, Yukihisa, entitled "Molten Metal Supplying Furnance".

* cited by examiner

*Primary Examiner*—Scott Kastler
(74) *Attorney, Agent, or Firm*—Wenderoth, Lind & Ponack, L.L.P.

(57) ABSTRACT

An automatic molten metal injector is provided which has no rotary frictional parts and is thus durable. The injector has a furnace holding a molten metal to a predetermined level and having a first port. A fixed sleeve is provided in the furnace so as to be submerged in the molten metal and has a second port communicating with the first port. A slide sleeve having a side wall formed with a third port and a closed bottom wall is received in the fixed sleeve so as to be vertically slidable between a raised position in which the third port communicates with the second port, and a lowered position in which the third port communicates with the interior of the furnace. A piston is vertically slidably received in the slide sleeve. A drive unit individually or simultaneously raises and lowers the slide sleeve and the piston.

7 Claims, 7 Drawing Sheets

AUTOMATIC MOLTEN METAL INJECTOR

BACKGROUND OF THE INVENTION

This invention relates to an automatic molten metal injector for poring molten metal into a mold for e.g. sand mold casting.

One of such injectors is disclosed in Japanese patent publication 8-47765 which was filed by the applicant of the present invention.

This injector is mounted in a furnace holding molten metal, and comprises a sheath, a rotary cylinder received in the sleeve, and a piston vertically slidably received in the cylinder. The cylinder is formed at one end with a port adapted to communicate with the interior of the furnace when the cylinder is rotated to a first position, and to communicate with a mold through a discharge chamber in a second position. With the cylinder rotated to the first position, the piston is raised to suck molten metal into the cylinder through the port. The cylinder is then rotated to the second position, and the piston is lowered to discharge a predetermined amount of the molten metal in the cylinder into the mold through the discharge chamber.

Since the material is fed in a molten state, there is no possibilility of explosion even during magnesium die casting. Since the injector is mounted in the furnace, it is possible to reduce the size of the entire device, minimize the loss of energy and reduce the volume, and shorten the molten metal holding time. This in turn makes it possible to reduce the production of sludge oxides.

With this injector, since communication between the interior of the furnace and the molten metal discharge chamber is controlled by rotating the cylinder, while the cylinder is rotated, the cylinder, sleeve and piston tend to get worn rather severely. This shortens the life of the injector.

An object of the invention is to provide an automatic molten metal injector having no rotary frictional parts yet is still sufficiently durable.

SUMMARY OF THE INVENTION

According to the present invention, there is provided an automatic molten resin injector comprising a furnace having a first port for holding a molten resin, a fixed sleeve provided in the furnace so as to be submerged in the molten resin and having a second port communicating with the first port, a slide sleeve comprising a side wall having a third port and a closed bottom and received in the fixed sleeve so as to be vertically slidable between a raised position in which the third port communicates with the second port, and a lowered position in which the third port communicates with the interior of the furnace, a piston vertically slidably received in the slide sleeve, and a drive unit for individually or simultaneously raising and lowering the slide sleeve and the piston.

Other features and objects of the present invention will become apparent from the following description made with reference to the accompanying drawings, in which:

DETAILED DESCRIPTION OF THE PREFERRED EMBODIMENTS

Figure 1:
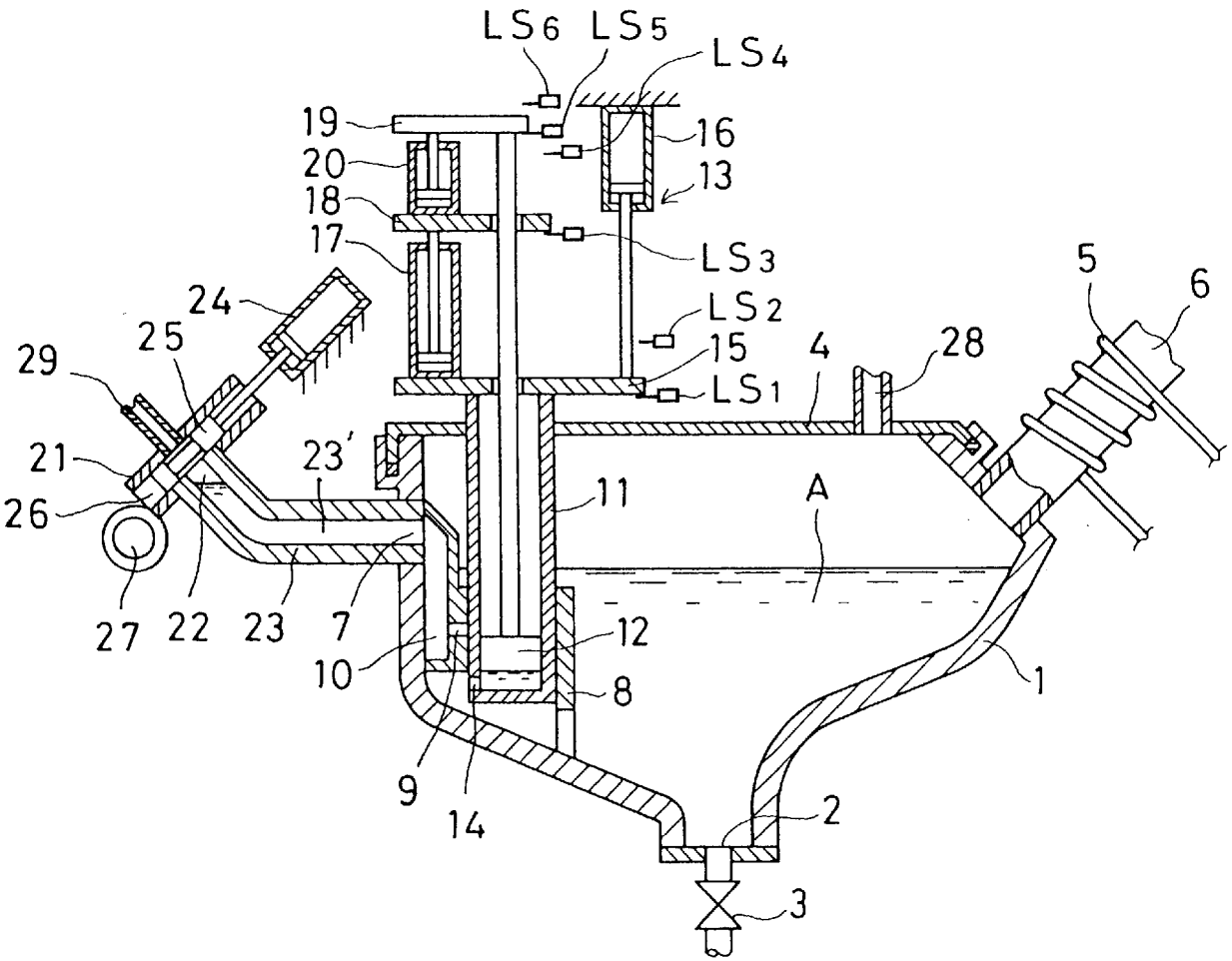
FIG. 1 is a vertical sectional view of an automatic molten metal injector embodying the invention, showing its initial position.

Now referring to the drawings, the automatic molten metal injector embodying the invention includes a furnace 1 having at its bottom a discharge port 2 closed by a drain valve 3 for holding molten metal, and a lid 4 airtightly closing the open top of the furnace 1. At its upper portion, the furnace 1 is provided with an ingot inlet port 6 around which is wound a heating coil 5. It is further provided with a molten metal outlet port 7 in its side wall.

A tubular vertical fixed sleeve 8 having an open top and bottom is provided in the furnace 1 near the outlet port 7 connecting with a pipe 23. The sleeve 8 is adapted to be submerged in molten metal A as shown. It has a molten metal outlet port 9 communicating with the outlet port 7 of the furnace 1 through a passage 10 separated from the interior of the furnace 1.

A slide sleeve 11 extends airtightly and vertically movably through the lid 4 and has its bottom slidably inserted in the fixed sleeve 8. A piston 12 is vertically slidably mounted in the slide sleeve 11. The slide sleeve 11 and the piston 12 have their tops coupled to a drive unit 13 provided over the lid 4 and are moved up and down together or independently by the drive unit 13.

The slide sleeve 11 is a cylinder with a closed bottom and is provided with an inlet port 14 in the side wall thereof near its bottom at such a position that it communicates with the outlet port 9 when the slide sleeve 11 has moved to its upper limit. When the sleeve 11 is at its lower limit, the inlet port 14 is located below the bottom of the fixed sleeve 8 and thus communicates with the interior of the furnace 1. In this position, molten metal naturally flows into the sleeve 11 through its inlet 14.

The drive unit 13 comprises three cylinders 16, 17, and 20. The first cylinder 16 has its body secured to a stationary portion and its downwardly protruding rod fixed to a first plate 15 which is secured to the top of the slide sleeve 11. The second cylinder 17 is mounted on the first plate 15 and supports a second plate 18 on the top of its upwardly protruding rod. The third cylinder 20 is mounted on the second plate 18 and has its upwardly protruding rod coupled to the piston 12 through a third plate 19 secured to the top of the piston 12. The first cylinder 16 moves the sleeve 11 up and down. The second and third cylinders 17 and 20 move the piston 12 up and down.

Limit switches LS1 and LS2 are fixed to the lid 4 and detect the first plate 15 to control the stroke of the first cylinder 16 such that the slide sleeve 11 is movable between an upper limit position in which the inlet port 14 of the sleeve 11 communicates with the outlet port 9 of the fixed sleeve 8 and a lower limit position in which the port 14 communicates with the interior of the furnace 1. Limit switches LS3 and LS4 are fixed to and movable with the first plate 15. Limit switches LS3 and LS4 are arranged such that the second plate 18 touches the switch LS3 when the second cylinder 17 is fully retracted as shown in FIG. 1 and touches the switch LS4 when it is fully extended. The port 14 communicates with the interior of the furnace 1.

Limit switches LS5 and LS6 are fixed to and movable with the second plate 18. They are arranged such that the third plate 19 touches the switch LS5 when the third cylinder 20 is fully retracted as shown in FIG. 1 and touches the switch LS6 when it is fully extended.

These limit switches are shown only in FIG. 1 but omitted in any other figures.

The pipe 23 has an outer end 22 connected to a molten metal supply sleeve 21 connected to a molten metal supply port 27 for an external mold. A plug 25 is inserted in the sleeve 21 so as to be axially slid in the sleeve 21 by a cylinder 24.

Molten metal A may be an aluminum alloy, zinc alloy, magnesium alloy, or any other material used in squeeze casting, die casting, gravity casting, sand mold casting or low-pressure metal mold casting.

The furnace 1 and the pipe 23 are provided with induction heaters or heating coils for heating molten metal inside. Gas supply pipes 28 and 29 are connected to the lid 4 and the molten metal sleeve 21, respectively, to supply inert gas into the furnace 1 and the pipe 23 to avoid oxidation of molten metal.

While not shown, a separate or second fixed sleeve may be provided between the fixed sleeve 8 and the slide sleeve 11. It is detachably fixed to a stationary portion outside the furnace 1 and formed with a port adapted to communicate with the port 9 of the fixed sleeve 8. The slide sleeve 11 is slidably mounted in the separate fixed sleeve. With this arrangement, the fixed sleeve 8 is subjected to no wear, and when the separate or second fixed sleeve gets worn, it can be replaced with a new one.

Figure 7:
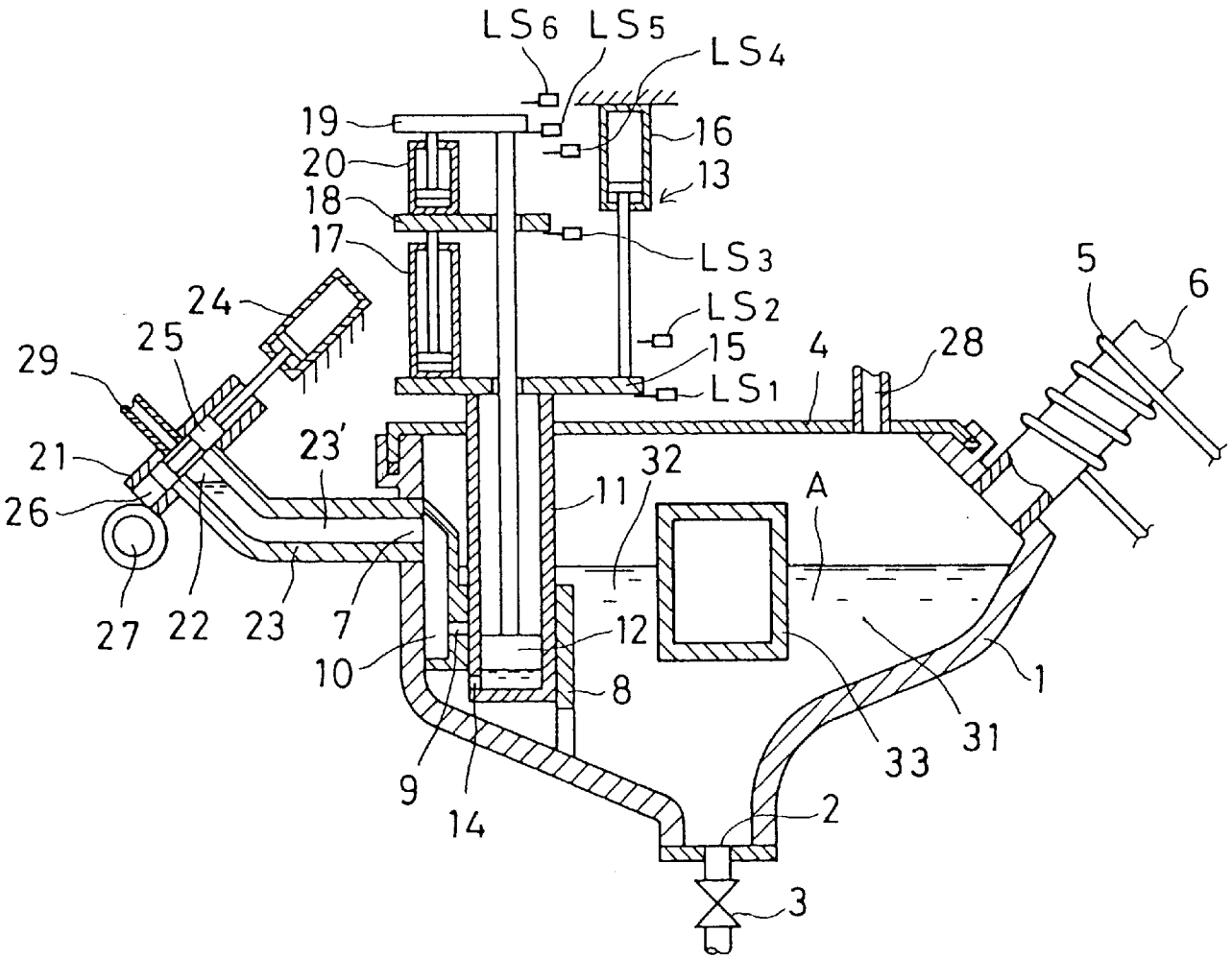
FIG. 7 is a vertical sectional view of a modified embodiment.

In the embodiment of FIG. 7, the interior of the furnace 1 is partitioned into a front compartment 31 and a rear compartment 32 by a hollow pillar member 33 extending across the furnace 1 while spaced from the bottom of the furnace. Thus, the front and rear compartments 31 and 32 communicate with each other under the member 33. The ingot inlet port 6 is in the front compartment 31 and the fixed sleeve 8, the slide sleeve 11 and the piston 12 are in the rear compartment 32.

With is arrangement, it is possible to minimize the temperature drop of the molten metal in the rear compartment 32 when ingots are put into the front compartment 31 through the inlet port 6, thus improving the injection cycle. Another advantage is that it is possible to reduce the volume of the molten metal in the furnace and increase the contact area of the furnace 1 includig the hollow member 33 with the molten metal and thus to heat the molten metal more efficiently.

It is also possible to adjust the temperatures of the molten metal in the respective compartments separately from each other and to prevent oxides produced in the molten metal when ingots are put into the furnace from migrating from the front compartment into the rear compartment and from mixing into injected molten metal.

Now in operation, FIG. 1 shows the initial position in which the first cylinder 16 is fully extended, so that the slide sleeve 11 is at the lowest position. In this state, the port 14 communicates with the interior of the furnace 1. Thus, a molten metal A can flow into the sleeve 11 through the port 14. The second and third cylinders 17 and 20 are both fully retracted in this state. Thus the piston 12 is in its lowest position. The plug 25 in the sleeve 21 is in an advanced position, so that the gas supply pipe 29 communicates with the pipe 23.

Figure 2:
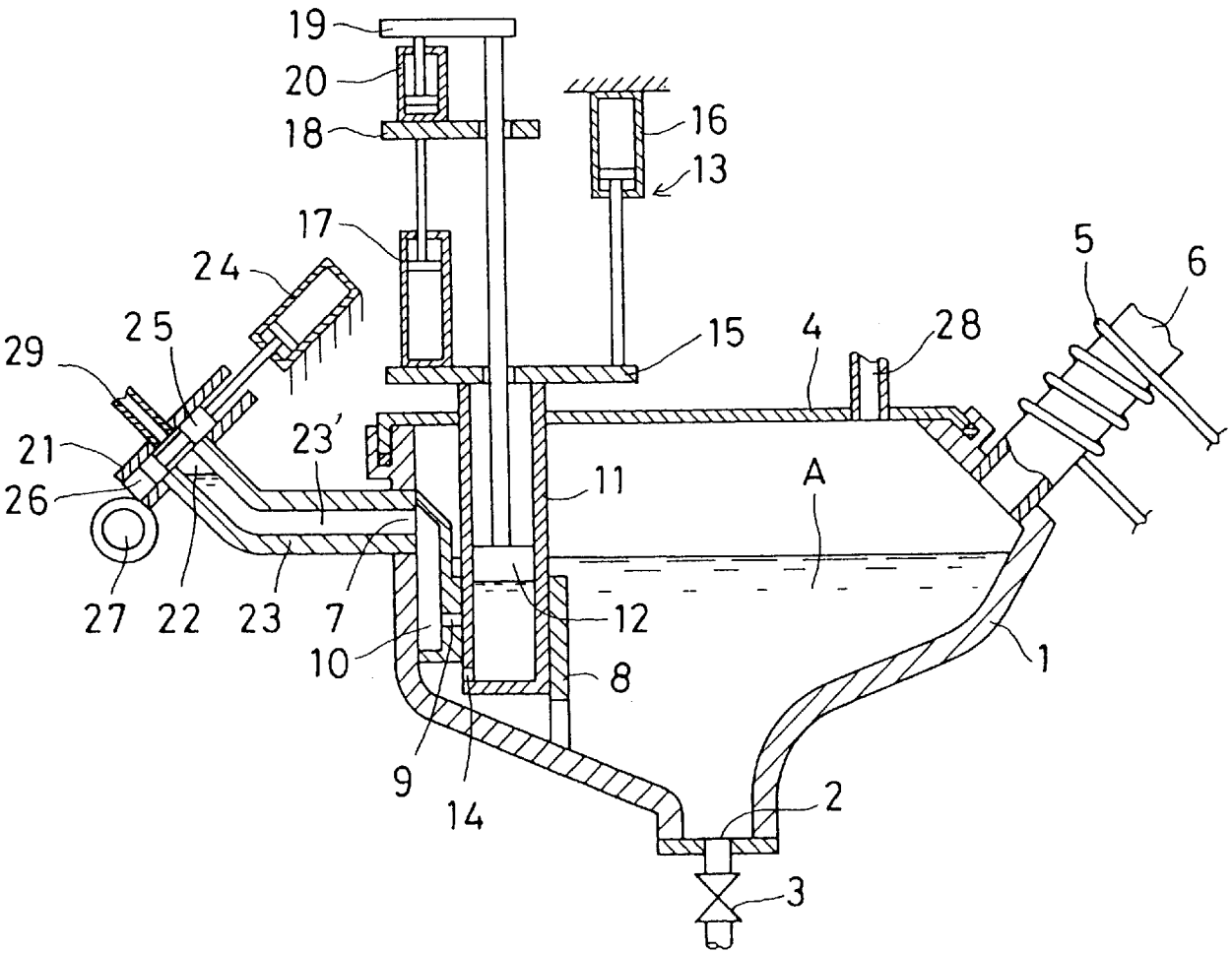
FIGS. 2, 3, 4 and 5 are similar views showing different positions.

From the position of FIG. 1, the second cylinder 17 is extended to its upper limit to raise the piston 12 to the position of FIG. 2 and thereby to suck a predetermined amount of molten metal through the port 14 into the sleeve 11.

Figure 3:
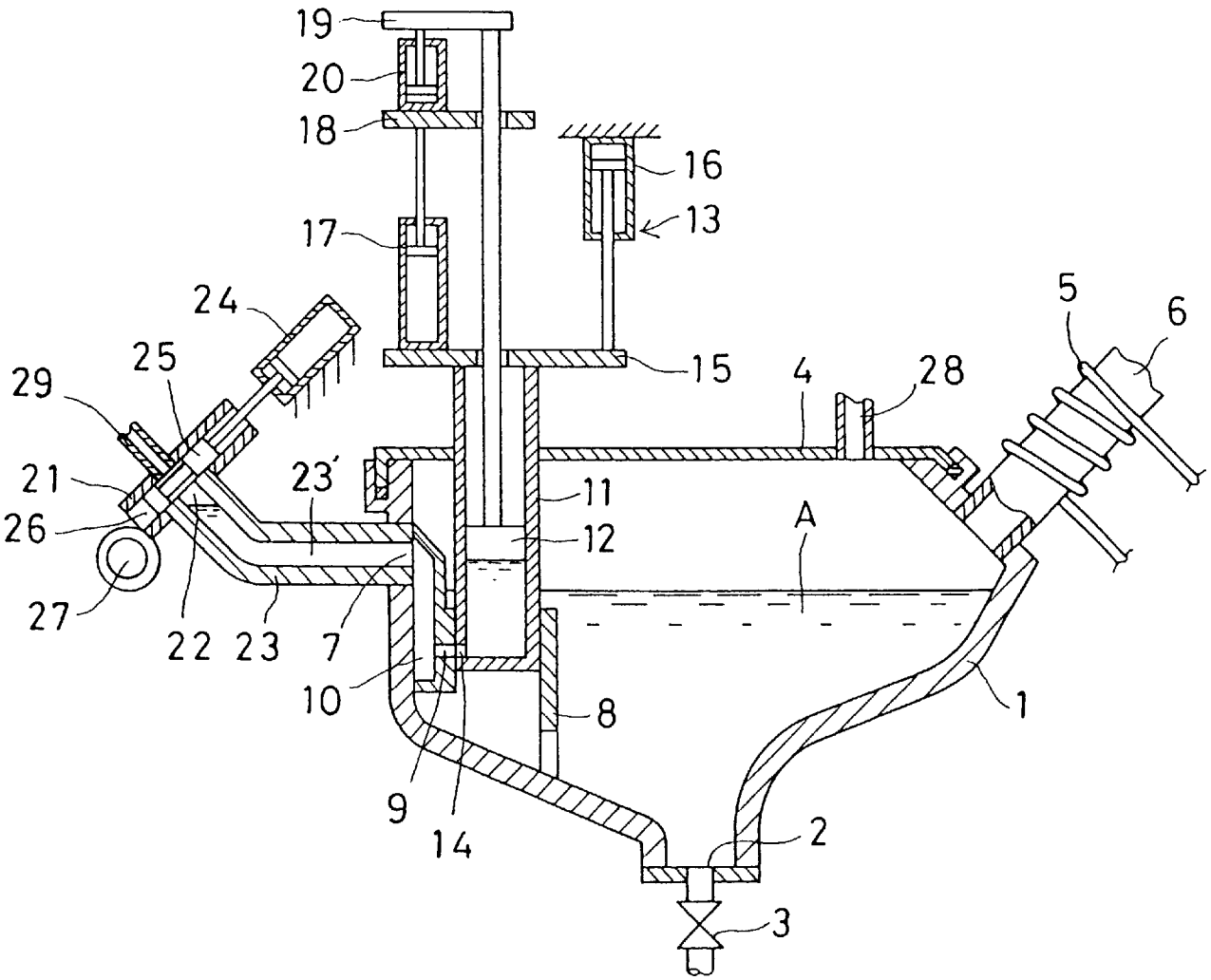

From the position of FIG. 2, the rod of the first cylinder 16 is retracted to its limit to raise the sleeve 11 together with the piston 12 to the position of FIG. 3 in which the interior of the sleeve 11 is now separated from the interior of the furnace 1 and the port 14 communicates with the port 9. Since the piston 12 is raised together with the sleeve 11 through the second and third cylinders 17, 20 and the first to third plates 15, 18, 19, the volume of the space in the sleeve 11 defined under the piston 12 remains unchanged, and so does the amount of the molten metal therein.

In the state of FIG. 3, by actuating the cylinder 24, the plug 25 in the sleeve 21 is retracted to open communication between the path 23' and the port 27 of the mold. Then the second cylinder 17 is retracted to is limit to the position of FIG. 4 to discharge molten resin in the sleeve 11 into the mold through the ports 14 and 9, paths 10 and 23, sleeve 21 and port 27.

Figure 4:
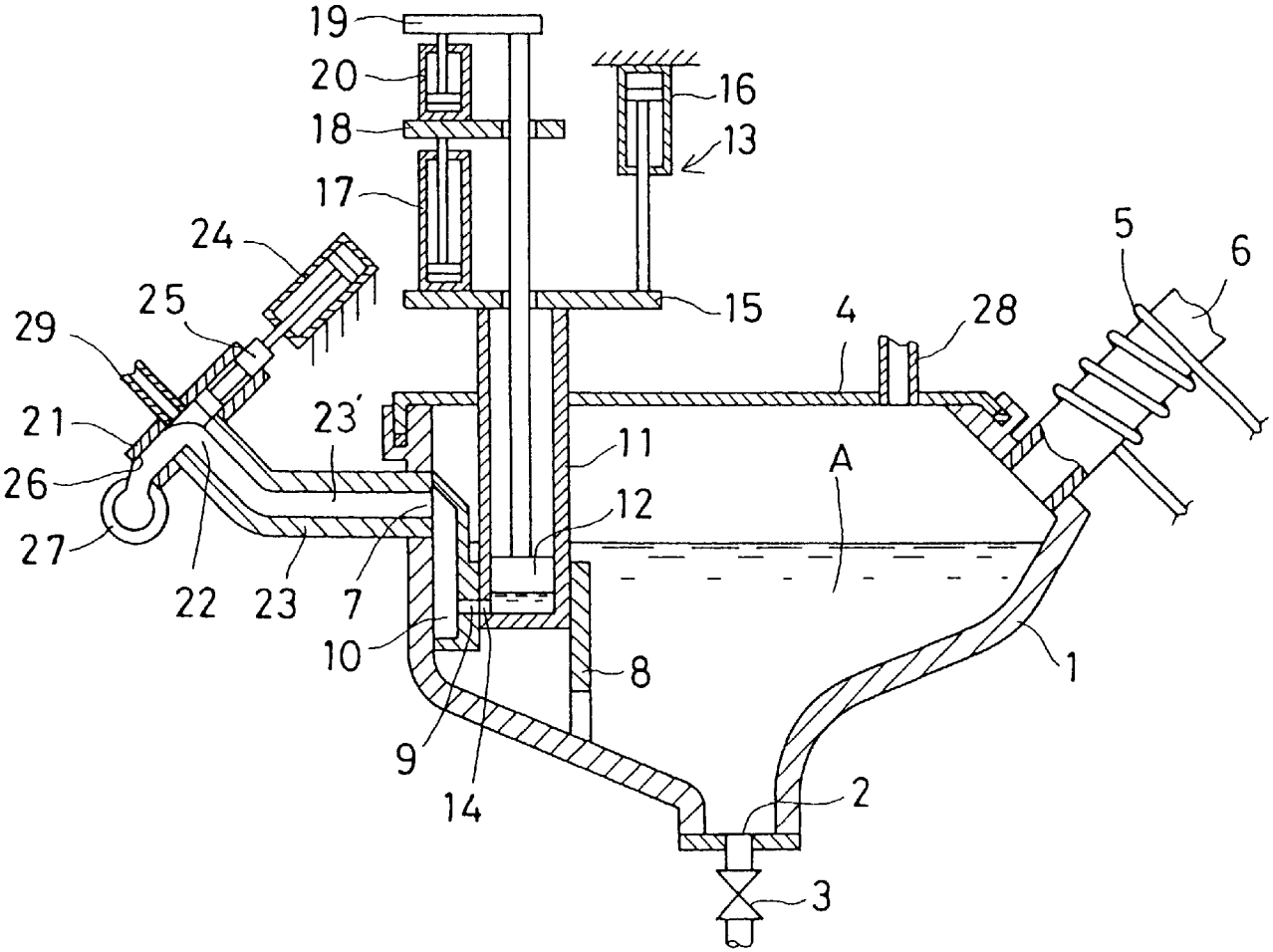
Figure 5:
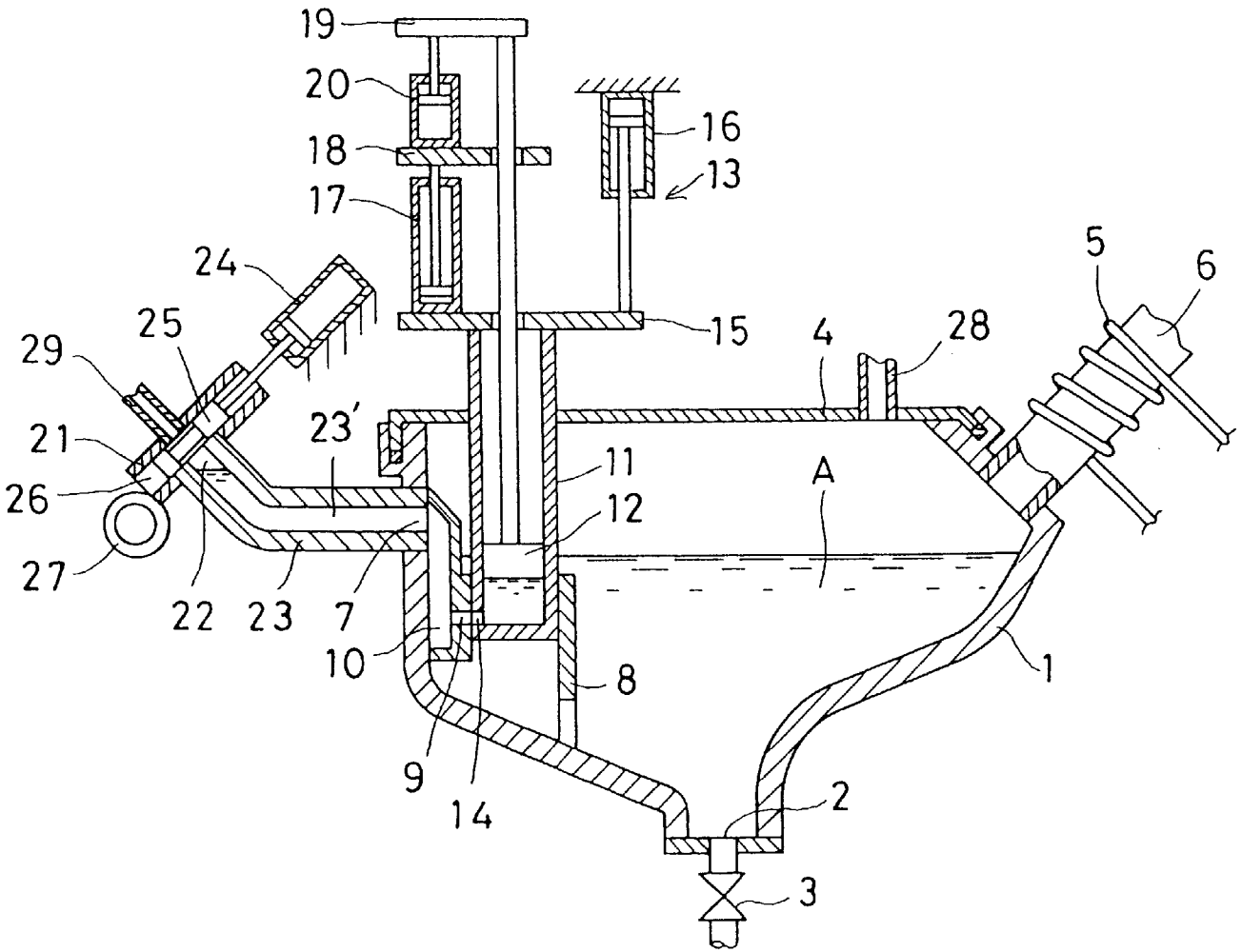
Figure 6:
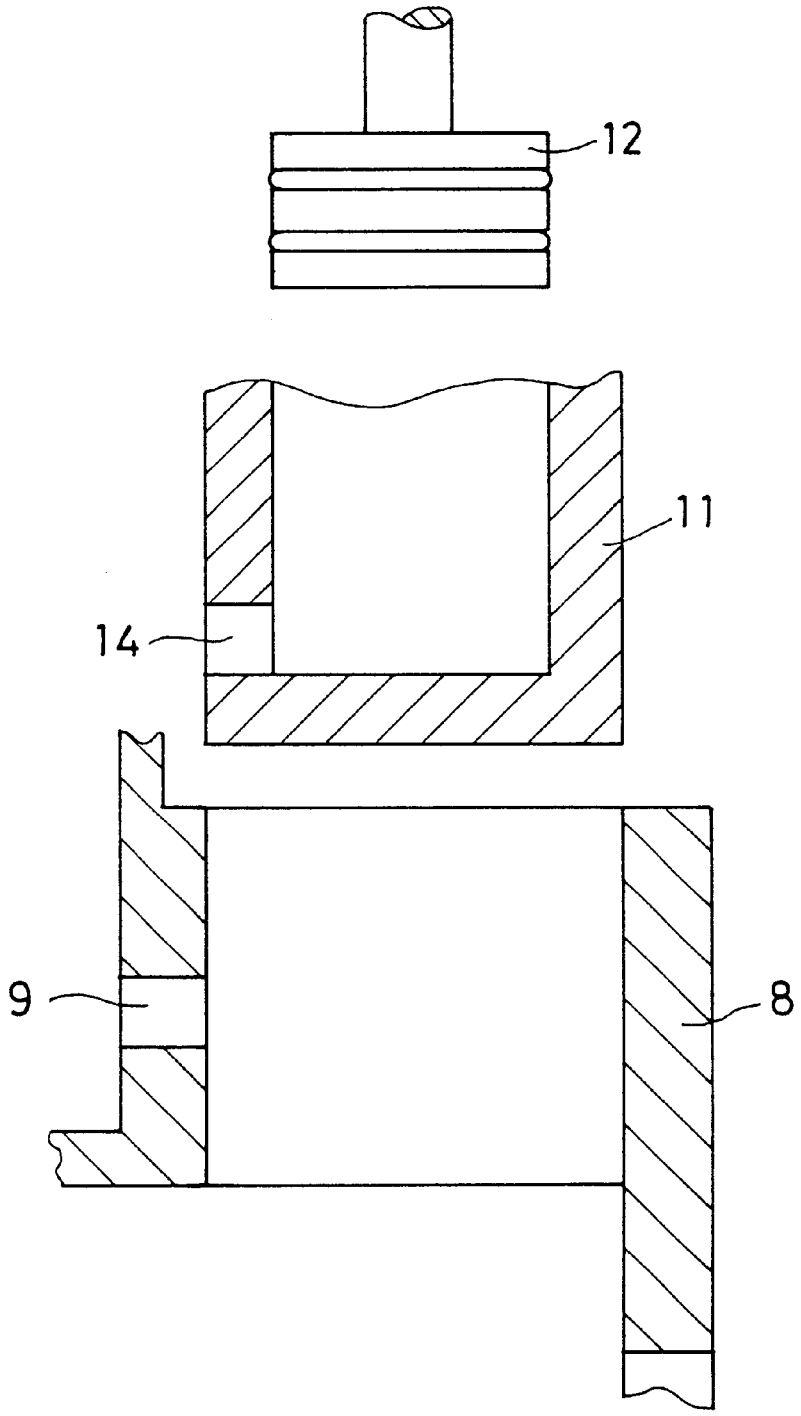
FIG. 6 is an enlarged vertical sectional view of a fixed sleeve, a slide sleeve and a piston.

When the discharge is complete, from the position of FIG. 4, the plug 25 is advanced to discharge any molten metal remaining in the sleeve 21 into the mold, and simultaneously, the third cylinder 20 is extended to its upper limit to raise the piston 12 to draw any molten metal remaining in the sleeve 23 and path 10 back into the sleeve 11. This ensures clear evacuation of molten metal in the sleeve 21. FIG. 5 shows the state when molten metal has been discharged.

From the position of FIG. 5, the first cylinder 16 is extended to lower the sleeve 11 to its lowermost position, and then the rod of the third cylinder 20 is retracted to its limit to lower the piston 12. Now, the injector of this invention returns to the state of FIG. 1.

By actuating three cylinders individually, it is possible to control the slide sleeve and the piston in a desired manner. Since there are no rotary parts, friction between the components is minimized and the durability of the components is considerably increased.

What is claimed is:

1. An automatic molten metal injector comprising:

a furnace for holding a molten metal, said furnace having a first port;

a fixed sleeve provided in said furnace so as to be submerged in the molten metal, said fixed sleeve having a second port communicating with said first port;

a slide sleeve having a side wall formed with a third port and a closed bottom, said slide sleeve being received in said fixed sleeve so as to be vertically slidable between a raised position in which said third port communicates with said second port, and a lowered position in which said third port communicates with an interior of said furnace;

a piston vertically slidably received in said slide sleeve; and a drive unit for selectively individually and simultaneously raising and lowering said slide sleeve and said piston.

2. The injector as claimed in claim 1 wherein said drive unit is provided outside said furnace, and comprises a first plate secured to said slide sleeve, a first cylinder for vertically moving said first plate and thus said piston, a second cylinder mounted on said first plate, a second plate supported on and coupled to said second cylinder so as to be moved vertically relative to said first plate by said second cylinder, a third cylinder mounted on said second plate, and a third plate supported on said third cylinder and coupled to said piston to move said piston vertically relative to said second plate by said third cylinder, said first cylinder moving said slide sleeve vertically, and said second and third cylinders moving said piston vertically.

3. The injector as claimed in claim 1 further comprising a further sleeve provided outside said furnace and having a fourth port communicating with said first port, a plug slidably received in said further sleeve, and a further cylinder for moving said plug in said further cylinder.

4. The injector as claimed in claim 1 further comprising a partitioning member for partitioning the interior of said furnace into first and second compartments, said first and second compartments communicating with each other under said partitioning member, an ingot inlet port being provided in said first compartment and said first port being provided in said second compartment.

5. The injector as claimed in claim 2 further comprising a further sleeve provided outside said furnace and having a fourth port communicating with said first port, a plug slidably received in said further sleeve, and a further cylinder for moving said plug in said further cylinder.

6. The injector as claimed in claim 2 further comprising a partitioning member for partitioning the interior of said furnace into first and second compartments, said first and second compartments communicating with each other under said partitioning member, an ingot inlet port being provided in said first compartment and said first port being provided in said second compartment.

7. The injector as claimed in claim 3 further comprising a partitioning member for partitioning the interior of said furnace into first and second compartments, said first and second compartments communicating with each other under said partitioning member, an ingot inlet port being provided in said first compartment and said first port being provided in said second compartment.

* * * * *